US006637439B2

(12) United States Patent
Hajaligol et al.

(10) Patent No.: US 6,637,439 B2
(45) Date of Patent: Oct. 28, 2003

(54) TOBACCO SMOKING MIXTURE FOR SMOKING ARTICLES SUCH AS CIGARETTES

(75) Inventors: Mohammad R. Hajaligol, Midlothian, VA (US); A. Clifton Lilly, Jr., Chesterfield, VA (US)

(73) Assignee: Philip Morris Incorporated, New York, NY (US)

( * ) Notice: Subject to any disclaimer, the term of this patent is extended or adjusted under 35 U.S.C. 154(b) by 40 days.

(21) Appl. No.: 09/942,882

(22) Filed: Aug. 31, 2001

(65) Prior Publication Data

US 2003/0041867 A1 Mar. 6, 2003

(51) Int. Cl.[7] ..... A24B 15/10; A24B 15/12

(52) U.S. Cl. ..... 131/352; 131/353; 131/357; 131/361; 131/363

(58) Field of Search ..... 131/347, 351–353, 131/356, 358, 360–364, 369, 370, 374; 162/139

(56) References Cited

U.S. PATENT DOCUMENTS

| | | | | |
|---|---|---|---|---|
| 3,545,448 A | | 12/1970 | Morman et al. | |
| 3,556,109 A | | 1/1971 | Briskin et al. | |
| 3,885,574 A | | 5/1975 | Borthwick et al. | |
| 3,943,942 A | | 3/1976 | Anderson et al. | |
| 3,960,770 A | | 6/1976 | Raley, Jr. et al. | |
| 4,008,723 A | | 2/1977 | Borthwick et al. | |
| 4,019,520 A | | 4/1977 | Strubel et al. | |
| 4,054,145 A | * | 10/1977 | Berndt et al. | 131/306 |
| 4,119,104 A | | 10/1978 | Roth | |
| 4,193,412 A | * | 3/1980 | Heim et al. | 131/342 |
| 4,256,126 A | | 3/1981 | Seligman et al. | |
| 4,317,460 A | | 3/1982 | Dale et al. | |
| 4,409,995 A | * | 10/1983 | Nichols | 131/84.1 |
| 4,452,259 A | | 6/1984 | Norman et al. | |
| 5,345,955 A | | 9/1994 | Clearman et al. | |
| 5,819,751 A | * | 10/1998 | Barnes et al. | 131/194 |
| 5,829,453 A | | 11/1998 | White et al. | |
| 5,915,388 A | | 6/1999 | Bowen et al. | |
| 6,202,651 B1 | * | 3/2001 | Luke et al. | 131/360 |
| 6,261,485 B1 | | 7/2001 | Klett | |

OTHER PUBLICATIONS

Notification of Transmittal of the International Search Report or the Declaration for PCT/US02/27467 dated Dec. 10, 2002.

* cited by examiner

*Primary Examiner*—Steven P. Griffin
*Assistant Examiner*—Carlos Lopez
(74) *Attorney, Agent, or Firm*—Burns, Doane, Swecker & Mathis, LLP

(57) ABSTRACT

A tobacco smoking mixture is provided that includes tobacco and at least one inorganic particulate material. The at least one inorganic particulate material is effective to reduce the temperature of a burning portion of the tobacco smoking mixture upon combustion/pyrolysis thereof. The at least one inorganic particulate material can be an inorganic carbonate, an inorganic hydrate, an inorganic oxide, an inorganic phosphate, a carbon material or combinations thereof.

45 Claims, No Drawings

TOBACCO SMOKING MIXTURE FOR SMOKING ARTICLES SUCH AS CIGARETTES

FIELD OF THE INVENTION

The present invention relates to a tobacco smoking mixture. In particular, the invention relates to a tobacco smoking mixture, for a smoking article such as a cigarette, which includes at least one inorganic particulate material. The inorganic particulate material is present in an amount effective to reduce the temperature of a burning portion of the tobacco smoking mixture upon combustion/pyrolysis thereof. The present invention also relates to methods for manufacturing such novel tobacco smoking mixtures.

BACKGROUND OF THE INVENTION

Tobacco smoking mixtures and/or smoking articles are disclosed in U.S. Pat. Nos. 3,545,448; 3,885,574; 3,943,942; 4,008,723; 4,019,520; 4,119,104; 4,452,259; and 5,345,955, the disclosures of which are hereby incorporated by reference.

Carbon and graphitic foams and methods of manufacturing carbon and graphitic foam materials are disclosed in U.S. Pat. Nos. 3,960,770 and 6,261,485. The '485 patent discloses carbon foams useful at high temperature and a process of making graphitic foam from a mesophase or isotropic pitch.

While there have been proposals in the prior art for modifications to tobacco smoking mixtures to include inorganic material, such proposals lead away from the present invention wherein a tobacco smoking mixture includes at least one inorganic particulate material which is present in an amount effective to reduce the temperature of a burning portion of the tobacco smoking mixture upon combustion/pyrolysis thereof.

SUMMARY OF THE INVENTION

The invention provides a tobacco smoking mixture which includes tobacco and at least one inorganic particulate material, wherein the at least one inorganic particulate material is present in an amount effective to reduce the temperature of a burning portion of the tobacco smoking mixture upon combustion/pyrolysis thereof. According to a preferred embodiment, the at least one inorganic particulate material comprises a material selected from the group consisting of an inorganic carbonate, an inorganic hydrate, an inorganic oxide, an inorganic phosphate, a carbon material and combinations thereof. The inorganic carbonate may comprise calcium carbonate, magnesium carbonate or combinations thereof. The inorganic oxide may comprise any suitable metal oxide such as, for example, titanium oxide, aluminum oxide, or the like. The carbon material may be selected from the group consisting of graphite, graphitic foam, carbon foam, fullerene, activated carbon and combinations thereof. The at least one inorganic particulate material is present in an amount effective to reduce the temperature of a burning portion of the tobacco smoking mixture, preferably to less than or equal to about 750° C., more preferably less than or equal to about 600° C. The at least one inorganic particulate material preferably comprises from an effective amount up to about 75% by weight based on the total weight of the tobacco smoking mixture.

According to another preferred embodiment, the tobacco smoking mixture comprises a tobacco smoking rod of a cigarette, and wherein the tobacco rod is preferably surrounded by a wrapper and an optional filter is at one end of the cigarette.

The invention also provides a method for manufacturing a tobacco smoking mixture for use in a smoking article, comprising the step of spraying tobacco with at least one inorganic particulate material, wherein the at least one inorganic particulate material is added to the mixture in an amount effective to reduce the temperature of a burning portion of the tobacco smoking mixture upon combustion/pyrolysis thereof.

The invention further provides a method for manufacturing a tobacco smoking mixture for use in a smoking article, comprising the steps of mixing at least one inorganic particulate material with tobacco, and casting the mixture into a sheet, wherein the at least one inorganic particulate material is added to the mixture in an amount effective to reduce the temperature of a burning portion of the tobacco smoking mixture upon combustion/pyrolysis thereof.

DETAILED DESCRIPTION OF THE PREFERRED EMBODIMENTS

According to the invention, a tobacco smoking mixture includes tobacco and at least one inorganic particulate material which is present in an amount effective to reduce the temperature of a burning portion of the tobacco smoking mixture upon combustion/pyrolysis thereof. This reduction in temperature may decrease the amount of particular high-temperature products produced by the combustion/pyrolysis of the tobacco smoking mixture. The inorganic particulate material may also be present in an amount effective to reduce the temperature of a burning portion of at least one component of a smoking article upon combustion/pyrolysis thereof. As used herein, the term "combustion/pyrolysis" is defined as combustion and/or pyrolysis.

The at least one inorganic particulate material is preferably present in an amount up to about 75% by weight, based on the total weight of the tobacco smoking mixture thus lowering the costs of cigarette manufacture significantly. The at least one inorganic particulate material is preferably homogeneously mixed with the tobacco in the tobacco smoking mixture. In a preferred embodiment, the at least one inorganic particulate material comprises a material selected from the group consisting of an inorganic carbonate, an inorganic hydrate, an inorganic oxide, an inorganic phosphate, a carbon material and combinations thereof. The inorganic carbonate may comprise, for example, calcium carbonate, magnesium carbonate or combinations thereof. The inorganic oxide may comprise a metal oxide such as, for example, titanium oxide, aluminum oxide or the like. The carbon material is selected from, for example, the group consisting of carbon foam, graphite, graphitic foam, fullerene, activated carbon and combinations thereof.

The at least one inorganic particulate material is preferably finely divided. For example, according to a preferred embodiment, the inorganic oxide comprises particles of less than about 10 $\mu$m (microns), more preferably less than about 5 $\mu$m, and most preferably less than about 1 $\mu$m.

According to a preferred embodiment, the at least one inorganic particulate material is present in an amount effective to reduce the temperature of a burning portion of the tobacco smoking mixture, for example, by at least about 50° C. to about 100° C. The temperature of the burning portion of the tobacco smoking article is preferably reduced to less than or equal to about 750° C., more preferably less than or equal to about 600° C. The at least one inorganic particulate material may be used to replace materials present in the tobacco smoking mixture which are more combustible than the inorganic particulate material, such as tobacco. The at least one inorganic particulate material may also conduct heat evolved by the combustion/pyrolysis reaction away from the burning portion of the tobacco smoking mixture, further reducing the temperature thereof. The presence of the at least one inorganic particulate material may change the burn rate of the smoking article. As used herein, the term "burning portion of the tobacco smoking mixture" includes any portion of the tobacco smoking mixture wherein combustion/pyrolysis of same occurs.

Reducing the temperature of the burning portion of the tobacco smoking mixture may decrease the production of particular high-temperature products and/or reduce second hand smoke. During the combustion of a smoking article containing tobacco, many chemical species are typically produced at temperatures higher than, for example, 600° C. These high-temperature reaction gases may include, for example, carbon monoxide (CO), nitrogen oxides ($NO_x$), aromatic and aliphatic hydrocarbons and the like. By reducing the temperature of the burning portion of the tobacco smoking mixture, it is desired to decrease the production of such high-temperature reaction gases.

The at least one inorganic material may also be present in an amount effective to reduce the temperature of a burning portion of one or more components of a smoking article upon combustion/pyrolysis thereof. Such components may include, for example, cigarette paper, tipping paper, filter paper or combinations thereof. To control the burn rate of the cigarette, the cigarette paper can be selected accordingly, e.g., a slower burning paper can be used to decrease the burn rate of the cigarette. A burning portion of the smoking article may burn at a lower temperature due to the presence of the at least one inorganic material in the tobacco smoking mixture. Reducing the temperature of the burning portion may decrease the production of particular high-temperature gases formed during the combustion/pyrolysis thereof. Such gases may include, for example, aromatic hydrocarbons. As used herein, the term "burning portion" includes any portion of the smoking article wherein combustion/pyrolysis of same occurs.

The at least one inorganic particulate material may provide other beneficial functions during combustion/pyrolysis of the tobacco smoking mixture. For example, if the inorganic particulate material includes a carbon material, free radicals produced by the combustion/pyrolysis reaction of the mixture may be adsorbed onto the surfaces of the carbon material. In addition, if the inorganic particulate material includes titanium oxide or activated carbon, tar molecules present in the combustion reaction gases may be broken down by the titanium oxide and/or activated carbon in the tobacco smoking mixture.

The tobacco smoking mixture of the present invention also includes tobacco. The tobacco preferably comprises at least about 50% by weight based on the total weight of the mixture. The tobacco typically functions, inter alia, as fuel in the combustion/pyrolysis of the tobacco smoking mixture. The tobacco may include, but is not limited to including, cut tobacco leaf filler that is typically found in cigarettes, expanded tobacco, extruded tobacco, reconstituted tobacco, tobacco stems, tobacco substitutes, synthetic tobacco, and blends thereof.

Additives may be included in the tobacco smoking mixture of the present invention to improve various characteristics thereof. For example, taste modifiers may be added to the mixture to improve its flavor. In addition, burn additives may be used to impart desirable burn characteristics to the tobacco and/or cigarette paper wrapper.

The tobacco smoking mixture may be manufactured using any suitable technique. For example, according to one embodiment of the invention, a method for manufacturing the mixture comprises the step of spraying tobacco with at least one inorganic particulate material. To facilitate spraying, the at least one inorganic particulate material preferably can be added to a liquid solution, and the solution can be sprayed onto the tobacco using conventional techniques. The mixture can then be processed using conventional techniques for preparation of the mixture for use in a smoking article. Alternatively, the mixture can be manufactured by mixing at least one inorganic particulate material with tobacco, and casting the mixture into a sheet. This sheet may then be processed into the tobacco smoking mixture using conventional techniques, and subsequently be used in the production of a smoking article.

Another technique for incorporating the inorganic particulate material in a tobacco smoking mixture involves adding the particulate material to a slurry of ingredients used to make reconstituted tobacco. The particulate material can be added to the slurry in any suitable amount, e.g. 5 to 25%, preferably 10 to 15% by weight. The slurry can be formed into reconstituted tobacco sheet by conventional processing and cut to appropriate size for incorporation as 100% filler of a tobacco rod or the cut strips can be added to tobacco rod filler material and the mixture formed into a tobacco rod.

Still yet, the inorganic particulate material can be added to a blend of ingredients used to make shredded reconstituted tobacco by extruding the blend and rolling the extruded material into strips. The strips can be cut to appropriate size for incorporation as 100% filler of a tobacco rod or the cut strips can be added to tobacco rod filler material and the mixture formed into a tobacco rod.

In a preferred embodiment, the tobacco smoking mixture comprises a tobacco rod of a cigarette. The tobacco rod may be surrounded by a wrapper. In addition, an optional filter may be disposed at one end of the cigarette. Techniques for assembling a cigarette from these components are conventional in the art.

While the invention has been described in detail with reference to specific embodiments thereof, it will be apparent to one skilled in the art that various changes and modification can be made, and equivalents thereof employed, without departing from the scope of the claims.

What is claimed is:

1. A tobacco smoking mixture, comprising tobacco and at least one inorganic particulate material selected from the group consisting of graphite, fullerene, carbon foam and graphitic foam, wherein the at least one inorganic particulate material is present in an amount effective to reduce the temperature of a burning portion of the tobacco smoking mixture upon combustion/pyrolysis thereof and the tobacco comprises at least about 50% by weight based on the total weight of the tobacco smoking mixture.

2. The tobacco smoking mixture according to claim 1, wherein the at least one inorganic particulate material further comprises a material selected from the group consisting of an inorganic carbonate, an inorganic hydrate, an inorganic oxide, an inorganic phosphate, a carbon material and combinations thereof.

3. The tobacco smoking mixture according to claim 2, wherein the carbon material comprises activated carbon.

4. The tobacco smoking mixture according to claim 2, wherein the inorganic oxide comprises a metal oxide wherein the metal oxide is optionally titanium oxide and/or aluminum oxide.

5. The tobacco smoking mixture according to claim 2, wherein the inorganic carbonate comprises a compound selected from the group consisting of calcium carbonate, magnesium carbonate and combinations thereof.

6. The tobacco smoking mixture according to claim 1, wherein the at least one inorganic particulate material comprises particles of less than 10 $\mu$m.

7. The tobacco smoking mixture according to claim 1, wherein the at least one inorganic particulate material comprises from an effective amount up to about 50% by weight based on the total weight of the tobacco smoking mixture.

8. The tobacco smoking mixture according to claim 1, wherein the at least one inorganic particulate material is present in an amount effective to reduce the temperature of a burning portion of the tobacco smoking mixture to less than or equal to about 750° C.

9. The tobacco smoking mixture according to claim 8, wherein the at least one inorganic particulate material is present in an amount effective to reduce the temperature of the burning portion of the tobacco smoking mixture to less than or equal to about 600° C.

10. The tobacco smoking mixture according to claim 1, wherein the tobacco smoking mixture comprises a tobacco rod of a cigarette.

11. The tobacco smoking mixture according to claim 10, wherein the tobacco rod is surrounded by a wrapper and an optional filter is at one end of the cigarette.

12. The tobacco smoking mixture according to claim 1, wherein the at least one inorganic particulate material is present in an amount effective to reduce the temperature of a burning portion of a cigarette upon combustion/pyrolysis thereof.

13. The tobacco smoking mixture according to claim 12, wherein the at least one component is selected from the group consisting of cigarette paper, tipping paper, filter paper and combinations thereof.

14. The tobacco smoking mixture according to claim 1, wherein the at least one inorganic particulate material comprises particles of less than about 1 micron.

15. The tobacco smoking mixture of claim 1, wherein the inorganic particulate material is present in an amount less than or equal to about 20% by weight of the total weight of the tobacco smoking mixture.

16. A method for manufacturing a tobacco smoking mixture for use in a smoking article, comprising the step of spraying tobacco with at least one inorganic particulate material selected from the group consisting of carbon foam, graphitic foam, graphite and fullerene, wherein the at least one inorganic particulate material is added to the tobacco smoking mixture in an amount effective to reduce the temperature of a burning portion of the tobacco smoking mixture upon combustion/pyrolysis thereof and the tobacco comprises at least about 50% by weight based on the total weight of the tobacco smoking mixture.

17. The method according to claims 16, wherein the at least one inorganic particulate material further comprises a material selected from the group consisting of an inorganic carbonate, an inorganic hydrate, an inorganic oxide, an inorganic phosphate, a carbon material and combinations thereof.

18. The method according to claim 17, wherein the carbon material comprises activated carbon.

19. The method according to claim 17, wherein the inorganic oxide comprises a metal oxide wherein the metal oxide is optionally titanium oxide and/or aluminum oxide.

20. The method according to claim 17, wherein the inorganic carbonate comprises a compound selected from the group consisting of calcium carbonate, magnesium carbonate and combinations thereof.

21. The method according to claim 16, wherein the at least one inorganic particulate material comprises particles of less than about 10 $\mu$m.

22. The method according to claim 16, wherein the at least one inorganic particulate material comprises from an effective amount up to about 50% by weight based on the total weight of the tobacco smoking mixture.

23. The method according to claim 16, wherein the at least one inorganic particulate material is present in an amount effective to reduce the temperature of a burning portion of the tobacco smoking mixture to less than or equal to about 750° C.

24. The method according to claim 23, wherein the at least one inorganic particulate material is present in an amount effective to reduce the temperature of the burning portion of the tobacco smoking mixture to less than or equal to about 600° C.

25. The method according to claim 16, wherein the tobacco smoking mixture comprises a tobacco rod of a cigarette.

26. The method according to claim 25, wherein the tobacco rod is surrounded by a wrapper and an optional filter is at one end of the cigarette.

27. The method according to claim 16, wherein the at least one inorganic particulate material is present in an amount effective to reduce the temperature of a burning portion of a cigarette upon combustion/pyrolysis thereof.

28. The method according to claim 27, wherein the at least one component is selected from the group consisting of cigarette paper, tipping paper, filter paper and combinations thereof.

29. The method according to claim 16, wherein the inorganic particulate material is present in an amount less than or equal to about 20% by weight of the total weight of the tobacco smoking mixture.

30. A method for manufacturing a tobacco smoking mixture for use in a smoking article, comprising the steps of mixing at least one inorganic particulate material with tobacco, and casting the mixture into a sheet, wherein the at least one inorganic particulate material is selected from the group consisting of graphite, fullerene, carbon foam and graphitic foam, and the inorganic particulate material is added to the mixture in an amount effective to reduce the temperature of a burning portion of the tobacco smoking mixture upon combustion/pyrolysis thereof and the tobacco comprises at least about 50% by weight based on the total weight of the tobacco smoking mixture.

31. The method according to claim 30, wherein the at least one inorganic particulate material further comprises a material selected from the group consisting of an inorganic carbonate, an inorganic hydrate, an inorganic oxide, an inorganic phosphate, a carbon material and combinations thereof.

32. The method according to claim 31, wherein the carbon material comprises activated carbon.

33. The method according to claim 31, wherein the inorganic oxide comprises a metal oxide wherein the metal oxide is optionally titanium oxide and/or aluminum oxide.

34. The method according to claim 31, wherein the inorganic carbonate comprises a compound selected from the group consisting of calcium carbonate, magnesium carbonate and combinations thereof.

35. The tobacco smoking mixture according to claim 30, wherein the inorganic particulate material comprises particles of less than about 10 $\mu$m.

36. The method according to claim 30, wherein the at least one inorganic particulate material comprises from an effective amount up to about 50% by weight based on the total weight of the tobacco smoking mixture.

37. The method according to claim 30, wherein the at least one inorganic particulate material is present in an amount effective to reduce the temperature of a burning portion of the tobacco smoking mixture to less than or equal to about 750° C.

38. The method according to claim 37, wherein the at least one inorganic particulate material is present in an amount effective to reduce the temperature of the burning portion of the tobacco smoking mixture to less than or equal to about 600° C.

39. The method according to claim 30, wherein the tobacco smoking mixture comprises a tobacco rod of a cigarette.

40. The method according to claim 39, wherein the tobacco rod is surrounded by a wrapper and an optional filter is at one end of the cigarette.

41. The method according to claim 30, wherein the at least one inorganic particulate material is present in an amount effective to reduce the temperature of a burning portion of a cigarette upon combustion/pyrolysis thereof.

42. The method according to claim 41, wherein the at least one component is selected from the group consisting of cigarette paper, tipping paper, filter paper and combinations thereof.

43. The method according to claim 30, wherein the inorganic particulate material is present in an amount less than or equal to about 20% by weight of the total weight of the tobacco smoking mixture.

44. A method for manufacturing a tobacco smoking mixture for use in a smoking article, comprising the steps of mixing at least one inorganic particulate material with tobacco, and casting the mixture into a sheet, wherein the at least one inorganic particulate material is selected from the group consisting of graphite, fullerene, carbon foam and graphitic foam, and the inorganic particulate material is added to the mixture in an amount effective to reduce the temperature of a burning portion of the tobacco smoking mixture upon combustion/pyrolysis thereof, wherein the inorganic particulate material is added to a tobacco slurry, the slurry is formed into sheet material, the sheet material is cut into strips and the strips are formed into a tobacco rod or the strips are added to tobacco which is formed into a tobacco rod, the tobacco rod is enclosed within cigarette paper to form a tobacco rod/cigarette paper assembly, and cigarette rods are formed by severing the tobacco rod/cigarette paper assembly into sections.

45. A method for manufacturing a tobacco smoking mixture for use in a smoking article, comprising the steps of mixing at least one inorganic particulate material with tobacco, and casting the mixture into a sheet, wherein the at least one inorganic particulate material is selected from the group consisting of graphite, fullerene, carbon foam and graphitic foam, and the inorganic particulate material is added to the mixture in an amount effective to reduce the temperature of a burning portion of the tobacco smoking mixture upon combustion/pyrolysis thereof, wherein the inorganic particulate material is added to a blend of ingredients suitable for manufacture of shredded reconstituted tobacco, the blend with particulate material is extruded into rods, the rods are rolled into strips, and the strips are formed into a tobacco rod or the strips are added to tobacco which is formed into a tobacco rod, the tobacco rod is enclosed within cigarette paper to form a tobacco rod/cigarette paper assembly, and cigarette rods are formed by severing the tobacco rod/cigarette paper assembly into sections.

* * * * *